US007198180B2

(12) United States Patent
Foster et al.

(10) Patent No.: US 7,198,180 B2
(45) Date of Patent: Apr. 3, 2007

(54) CONTAINER CLOSURE WITH BIASED CLOSED TUBE VALVE

(75) Inventors: Donald D. Foster, St. Charles, MO (US); Martin S. Laffey, St. Peters, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 11/222,432

(22) Filed: Sep. 8, 2005

(65) Prior Publication Data

US 2007/0051755 A1 Mar. 8, 2007

(51) Int. Cl.
*B65D 5/72* (2006.01)

(52) U.S. Cl. ..... 222/494

(58) Field of Classification Search ..... 222/494
See application file for complete search history.

(56) References Cited

U.S. PATENT DOCUMENTS 6,223,956 B1 * 5/2001 Albers ..... 222/494
6,367,668 B1 * 4/2002 Schwanenberg ..... 222/490
6,378,742 B1 * 4/2002 Rohr et al. ..... 222/494
6,641,003 B1 11/2003 Foster et al.
6,749,092 B2 * 6/2004 Olechowski et al. ..... 222/514
6,840,408 B1 1/2005 Foster et al.
6,923,346 B2 8/2005 Foster et al.
2004/0178230 A1 * 9/2004 Feierabend ..... 222/494

* cited by examiner

*Primary Examiner*—Philippe Derakshani
(74) *Attorney, Agent, or Firm*—Thompson Coburn LLP

(57) ABSTRACT

A closure is removably attachable to a container and comprises a dispensing orifice and a tubular valve element that is biased closed blocking communication of the container with the orifice. By inverting the container so that a liquid contents of the container exerts pressure on the valve element, or by squeezing the container causing the liquid contents to exert pressure on the valve element, the valve element opens communication with the dispensing orifice allowing the liquid contents to be dispensed from the container. On removing the pressure from the valve element, the valve element resiliently closes the dispensing orifice.

23 Claims, 4 Drawing Sheets

CONTAINER CLOSURE WITH BIASED CLOSED TUBE VALVE

BACKGROUND OF THE INVENTION (1) Field of the Invention

The present invention pertains to a closure for a container that is inverted and/or manually squeezed to dispense the contents of the container through an orifice of the closure. Specifically, the present invention pertains to a closure that is removably attachable to the container and comprises a dispensing orifice and a tubular valve element that is biased closed to block communication of the container with the dispensing orifice. By inverting the container so that a liquid contents of the container exerts pressure on the exterior surface of the valve element, or by squeezing the container causing the liquid contents to exert pressure on the exterior surface of the valve element, the valve element opens and allows the liquid contents to be dispensed from the container. On removing the pressure from the valve element, the valve element resiliently closes and again blocks the dispensing orifice.

(2) Description of the Related Art

Containers that are inverted and/or squeezed to dispense the liquid contents of the container are employed in dispensing a wide variety of products. Dispensers of this type are commonly used in dispensing household products, for example food condiments such as ketchup, mustard, and pancake syrup, and are also used in dispensing other products such as liquid soaps and glues. The container is typically flexible and resilient, which allows the container to be manually squeezed to exert a pressure on the contents of the container that forces a portion of the contents through a dispensing orifice of the container.

In order to keep the contents of the container fresh in the case of food condiments, or to keep the contents from drying out in the case of soap or glue, the container dispensing orifice is often provided with a closure. A simple example of a prior art closure is a cap that is screw threaded on a threaded neck of the container. Another example is a cap that is snapped onto the container covering over a dispensing spout. Each of these basic types of prior art closures are disadvantaged in that they require some manual movement of the cap to close the container dispensing orifice. When screw threading the cap on the container, it is possible to not completely screw thread the cap on the container. This could result in the cap falling off of the container, or could result in an incomplete seal of the container dispensing orifice. In a like manner, in snapping the cap on the container, it is possible for the cap to not be properly attached to the container. This also could result in the cap falling off of the container, or the cap not sealing the container dispensing orifice. In both situations, the container dispensing orifice is left unsealed, which could result in the spoiling of the container contents or the drying out of the container contents.

SUMMARY OF THE INVENTION

The container closure of the present invention overcomes the above described disadvantages associated with prior art container closures by providing a closure with a valve element that automatically opens when the container is inverted and/or manually squeezed, and automatically closes when the container is positioned uprightly and there is no squeezing pressure on the container.

The container closure of the invention has a simple construction that is comprised of two component parts, a closure base that includes a lid, and the valve element. Each of the component parts is constructed of a plastic, with the plastic of the valve element being more flexible and more resilient than the plastic of the closure base.

The closure base is constructed similar to a typical cap that is screw threaded on the screw threaded neck of a container. The base has a cylindrical side wall with a circular exterior surface and a circular interior surface at opposite ends of the side wall. A dispensing orifice extends through the base between the interior and exterior surfaces. A cylindrical cavity is recessed into the base interior surface. A cylindrical wall on the base interior surface surrounds the cavity. A first portion of the wall has internal screw threading that removably attaches the base onto the external screw threading that surrounds an opening of a complementary container. The first portion of the cylindrical wall also surrounds and is concentric with the dispensing orifice of the base. Thus, attaching the base interior surface to the container aligns the base orifice with the container opening.

A second portion of the cylindrical wall forms the interior of a dispensing spout that projects outwardly from the base exterior surface. The dispensing orifice is on the distal end of the spout. The second portion of the cylindrical wall surrounds the interior of the spout and is concentric with the dispensing orifice and the first portion of the cylindrical wall. An annular rim projects from the base interior surface between the first portion of the cylindrical wall and the second portion of the cylindrical wall.

A lid is attached to the base by a living hinge. The hinge allows the lid to be moved between a closed position where the lid is positioned over the base exterior surface and over the spout and dispensing orifice, and an opened position where the lid is displaced from the base exterior surface and the dispensing orifice.

A valve element having an integral valve retainer is mounted to the base interior surface. The valve retainer has a cylindrical peripheral surface that engages with the annular rim on the base interior surface in attaching the valve retainer and the valve element to the base. At least one liquid passage hole extends through the valve retainer. The hole is positioned inwardly from the valve retainer peripheral surface, and is positioned outwardly of the valve element.

The valve element has a tubular shape that is coaxial with the cylindrical peripheral surface of the valve retainer. The valve element projects from the valve retainer and is positioned between the valve retainer and the base interior surface. The tubular valve element has opposite exterior and interior surfaces, with the valve element exterior surface opposing the base interior surface and the valve element interior surface surrounding the base dispensing orifice.

The resiliency and flexibility of the valve element allows the valve element to move between closed and opened positions relative to the base and the base dispensing orifice. The resiliency of the valve element biases the valve element to the closed position where the exterior surface of the valve element engages against the second portion of the base cylindrical wall and closes communication through the base cavity to the dispensing orifice. When the container closure is attached to a liquid container and the pressure of the liquid in the container is increased, for example by inverting the container and/or squeezing the container, the liquid flows through the retainer hole to the valve element exterior surface. The pressure of the liquid causes the valve element to flex away from the second portion of the base cylindrical wall and opens communication between the container attached to the container closure and the base dispensing orifice.

BRIEF DESCRIPTION OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

Figure 1:
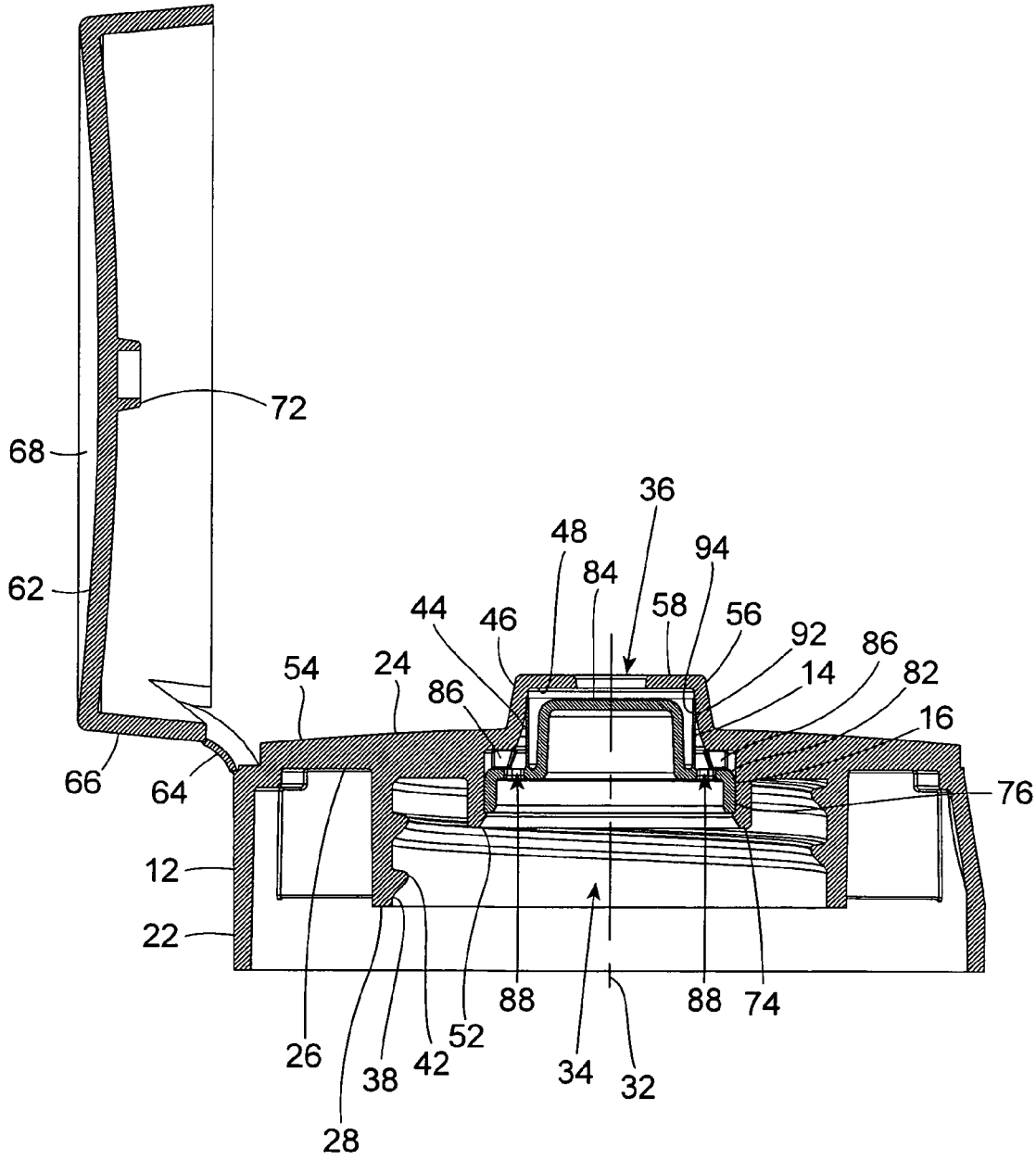
FIG. 1 is a side elevation view, in section, showing the container closure of the invention with the closure lid in its opened position.

The container closure of the invention has a simplified, inexpensive construction that is comprised of only two component parts. The closure is designed to be removably attachable to a container by being screw threaded on a threaded neck of the container that surrounds the dispensing opening of the container. Alternatively, the closure could be snap fit to the container over the container dispenser opening, or be attached to the container by some other method, for example by a bayonet fitment. Although a screw threaded connector will be described on the container closure, the container closure should not be interpreted as being limited to this particular type of connector.

As stated earlier, in the preferred embodiment of the invention, each of the component parts of the container closure is constructed of a plastic material. The two basic component parts of the container closure include a closure base 12, and a valve element 14 having an integral valve retainer 16. The plastic material of the valve element 14 is more flexible and more resilient than the plastic material of the base 12.

The closure base 12 has a cylindrical configuration and a similar construction to a typical cap that is screw threaded on the screw threaded neck of a container. The base 12 has a cylindrical side wall 22 with a circular exterior surface 24 and a circular interior surface 26 at the opposite ends of the side wall.

The interior surface 26 is designed to be removably attachable to a separate liquid container over the dispensing opening of the container. To accomplish this, a cylindrical wall 28 having a center axis 32 is provided on the base interior surface 26. The cylindrical wall 28 surrounds a cavity 34 that extends upwardly through the base and communicates with a dispensing orifice 36 of the base. The cylindrical wall 28 has a first portion 38 that is provided with internal screw threading 42. The screw threading 42 is designed to removably attach the container closure base 12 to a separate liquid container. The cylindrical wall also has a second portion 44 that has a smaller interior diameter dimension than the first portion 38 of the cylindrical wall. The cylindrical wall second portion 44 is contained inside a cylindrical spout 46 that projects outwardly from the base exterior surface 24. The base cavity 34 extends upwardly through the cylindrical wall second portion 44 to an end wall 48 of the cavity that has the dispensing orifice 36. The interior surface of the cylindrical wall second portion 44 is smooth and functions as a valve seating surface, as will be explained.

An annular rim 52 projects outwardly from the base interior surface 46. The rim 52 is positioned between the cylindrical wall first portion 38 and the cylindrical wall second portion 44. As seen in the drawing figures, the diameter dimension of the annular rim 52 is smaller than that of the cylindrical wall first portion 38, and is larger than that of the cylindrical wall second portion 44.

The base exterior surface 24 has a flat, annular portion 54 that extends inwardly from the base side wall 22 toward the dispensing orifice 36. As the flat annular surface 52 extends toward the orifice 36 it merges into a truncated conical portion 56 of the exterior surface 24. This conical portion 56 of the surface forms the spout 46. The spout 46 extends outwardly from the flat annular surface portion 54 to an annular end surface 58 that surrounds the dispensing orifice 36.

Figure 2:
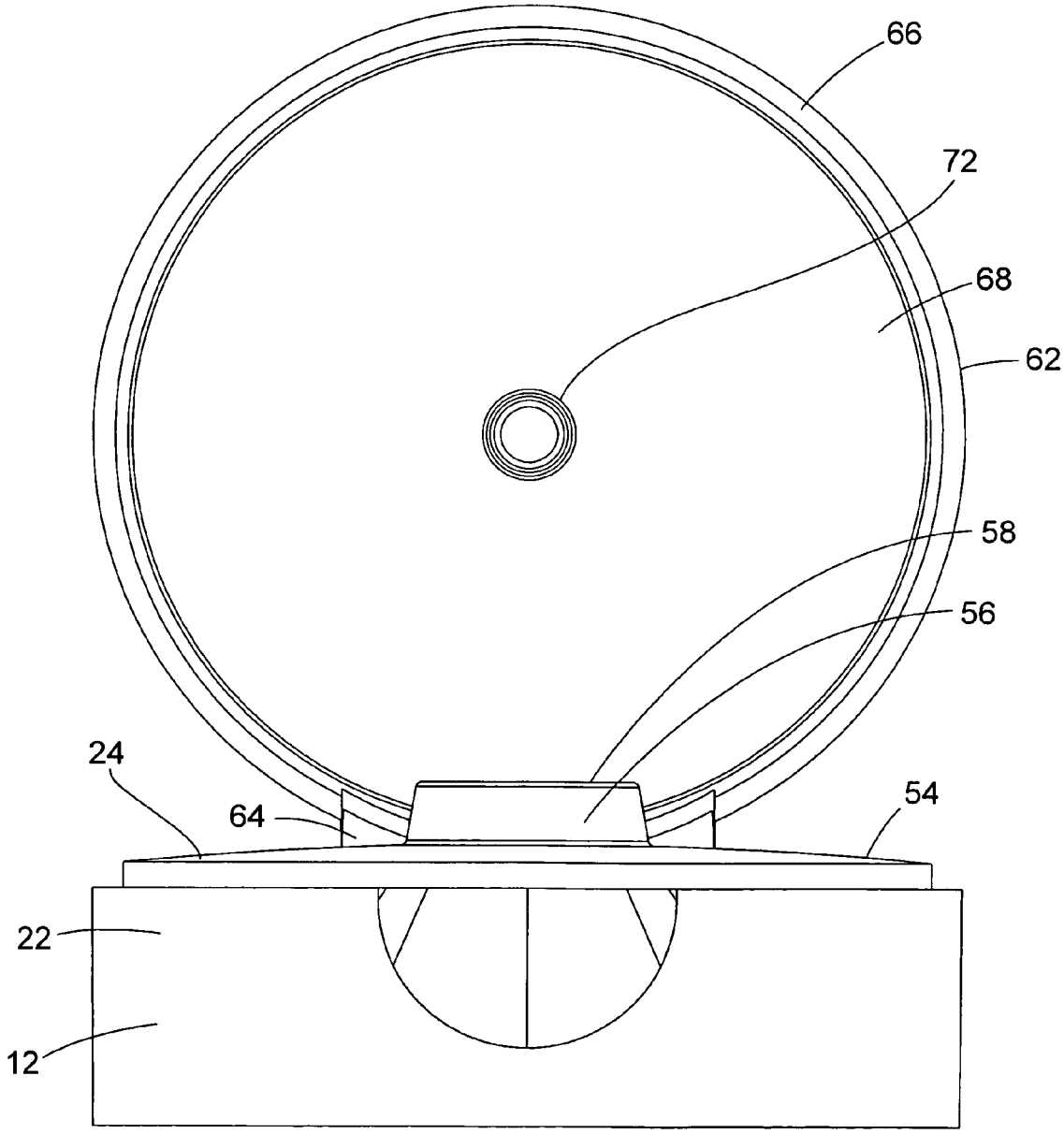
FIG. 2 is a front elevation view of the container closure shown in FIG. 1.
Figure 3:
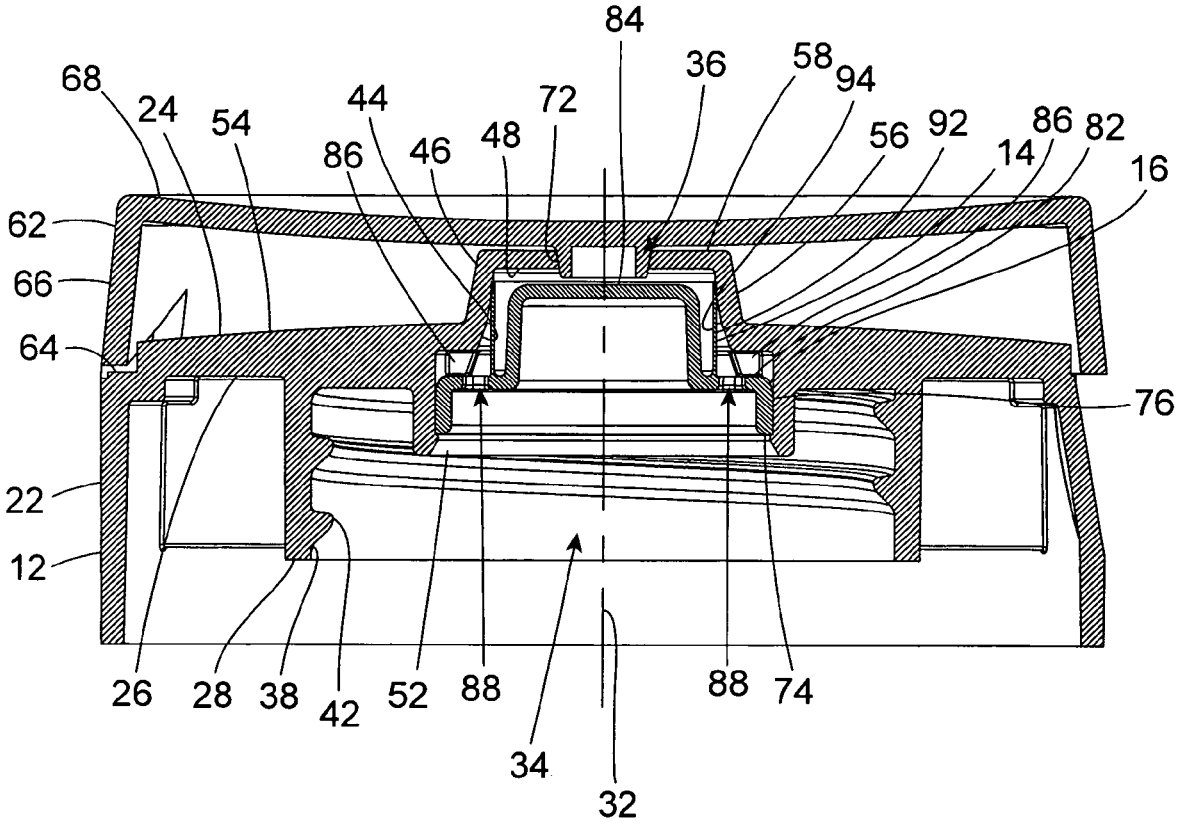
FIG. 3 is an elevation view, in section, showing the container closure with the lid in its closed position; and, FIG. 4 is a front elevation view of the container closure as shown in FIG. 3.
Figure 4:
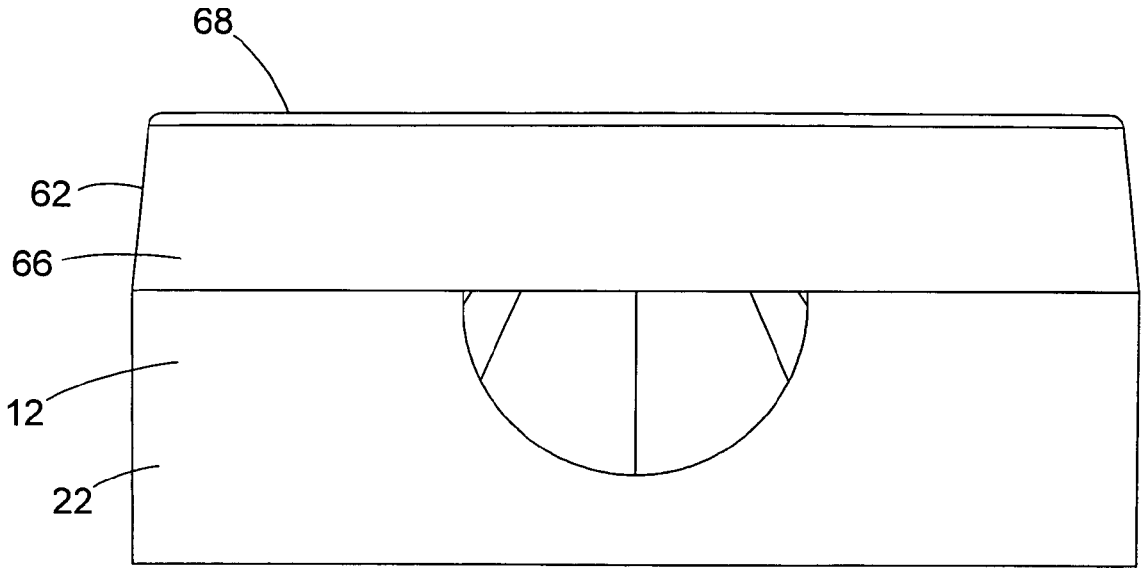

A lid 62 is connected to the base 12 by an integral, living hinge 64. In alternate embodiments of the invention, the lid 62 could be separate from the base 12. The lid 62 has a cylindrical side wall 66 that is connected to the hinge 64. A circular top wall 68 of the lid extends inwardly from the side wall 66 toward a center, cylindrical protrusion 72 on the lid. The hinge 64 allows the lid 62 to move between a closed position over the dispensing orifice 36 shown in FIGS. 3 and 4, to an opened position where the lid 62 is displaced from the base exterior surface 24 and the dispensing orifice 36 shown in FIGS. 1 and 2. The protrusion 72 is dimensioned to engage inside the dispensing orifice 36 to seal the orifice closed when the lid is moved to its closed position shown in FIGS. 3 and 4.

The valve retainer 14 has a cylindrical wall 74 with a peripheral surface portion 76 that is dimensioned to engage inside the annular rim 52 of the base and attach the valve retainer 14 to the base 12. A flat, circular platform 82 extends across the valve retainer cylindrical wall 74. A center post 84 projects upwardly from the top surface of the platform 82. A plurality of tabs 86 surround the post 84 and project upwardly from the valve retainer platform 82. Tabs 86 are spatially arranged around the platform and are dimensioned to engage the base interior surface 26 to properly axially position the valve retainer 16 inside the base annular rim 52. The tabs 86 also properly position the valve retainer 16 relative to the cylindrical wall second portion 44 in the interior of the dispensing spout 46. A plurality of liquid passage holes 88 extend through the valve retainer platform 82. The holes 88 are also spatially arranged around the platform and are positioned between the platform tabs 86.

The valve element 14 has a cylindrical, tubular shape that projects upwardly from the valve retainer platform 82. The valve element 14 is positioned radially outside the center post 84 of the retainer and radially inside the plurality of retainer tabs 86 and the plurality of retainer holes 88. A circular top edge 92 of the valve element is positioned just above the retainer center post 84 and just below the annular end surface 48 in the interior of the base spout 46. The cylindrical exterior surface 92 of the valve element 14 engages against the interior surface of the base cylindrical wall second portion 44. The opposite cylindrical interior surface 94 of the valve element 14 extends around the base dispensing orifice 36.

The resiliency and the flexibility of the valve element 14 allows the valve to move between closed and opened positions relative to the base 12 and the dispensing orifice 36. FIG. 1 shows the valve element 14 in its closed position with the lid 62 moved to its opened position relative to the base 12. The resiliency of the cylindrical tubular shape of the valve element 14 positions the cylindrical exterior surface 92 of the valve against the cylindrical interior surface of the base cylindrical wall second portion 44, and positions the valve cylindrical interior surface 94 extending around the dispensing orifice 36. The resiliency of the valve element 14 biases the valve to this position shown in FIG. 1.

When the closure base 12 is attached to a liquid container, the container opening is aligned with the base dispensing orifice 36. When the liquid container is inverted and/or a squeezing pressure is exerted on the container, liquid passes through the dispensing opening of the container and through the liquid passageway defined by the retainer holes 88. The liquid under pressure enters the area between the valve element cylindrical exterior surface 92 and the interior surface of the base cylindrical wall second portion 44. The fluid pressure acts against the valve element 14, causing the tubular valve element to resiliently flex inwardly away from the interior surface of the base cylindrical wall second portion 44, opening communication between the container opening and the dispensing orifice 36. This allows liquid to be dispensed from the liquid container through the dispensing orifice 36. When the liquid pressure is removed from the cylindrical exterior surface 92 of the valve element 14, the resiliency of the valve element pushes the exterior surface 92 back into engagement with the interior surface of the base cylindrical wall second portion 44 and blocks communication between the container opening and the dispensing orifice 36. To further seal the dispensing orifice 36, the lid 62 can be attached over the base exterior surface 24 positioning the lid cylindrical protrusion 72 in the base dispensing orifice 36.

Although the container closure of the invention has been described above by reference to a single embodiment, it should be understood that modifications and variations could be made to the closure without departing from the intended scope of the invention defined by the following claims.

The invention claimed is:

1. A container closure that is attachable to a container to cover over an opening of the container, the container closure comprising:

a base having opposite interior and exterior surfaces and an orifice passing through the base interior and exterior surfaces, the base interior surface being attachable to the container with the base orifice aligned with the container opening;

a valve retainer attached to the base interior surface around the base orifice; and, a tubular valve element positioned between the base interior surface and the valve retainer, the valve element having a center axis that defines mutually perpendicular axial and radial directions, the valve element being movable radially while being axially stationary relative to both the base and the valve retainer, the valve element moving radially between a closed position and an opened position where in the closed position the valve element engages the base interior surface and blocks communication of the base orifice with the opening of the container attached to the closure, and in the opened position the valve element is displaced from the base interior surface and opens communication of the base orifice with the opening of the container attached to the closure, and the valve element being biased to the closed position.

2. The container closure of claim 1, further comprising:

the valve element being a cylindrical tube that projects axially from the valve retainer to a circular top edge of the valve element.

3. The container closure of claim 1, further comprising:

the base having a cylindrical interior wall surrounding a cavity in the base interior surface; and, the valve retainer is positioned inside the cavity and engages with the interior wall in attaching the valve retainer to the base.

4. The container closure of claim 1, further comprising:

the base having a wall that surrounds the orifice; and, the valve retainer engaging with the base wall in attaching the valve retainer to the base.

5. The container closure of claim 4, further comprising:

the valve retainer having a peripheral surface that engages with the base wall in attaching the valve retainer to the base; and, the valve retainer having at least one hole through the valve retainer, the hole being spaced from the valve retainer peripheral surface.

6. A container closure that is attachable to a container to cover over an opening of the container, the container closure comprising:

a base having opposite interior and exterior surfaces and an orifice passing through the base interior and exterior surfaces, the base interior surface being attachable to the container with the base orifice aligned with the container opening;

a valve retainer attached to the base interior surface around the base orifice;

a tubular valve element positioned between the base interior surface and the valve retainer, the valve element being movable relative to both the base and the valve retainer between a closed position and an opened position where in the closed position the valve element engages the base interior surface and blocks communication of the base orifice with the opening of the container attached to the closure, and in the opened position the valve element is displaced from the base interior surface and opens communication of the base orifice with the opening of the container attached to the closure, and the valve element being biased to the closed position;

the base having a wall that surrounds the orifice;

the valve retainer engaging with the base wall in attaching the valve retainer to the base;

the valve retainer having a peripheral surface that engages with the base wall in attaching the valve retainer to the base;

the valve retainer having at least one hole through the valve retainer, the hole being spaced from the valve retainer peripheral surface; and, the valve retainer hole being positioned between the valve retainer peripheral surface and the valve element.

7. A container closure that is attachable to a container to cover over an opening of the container, the container closure comprising:

a base having opposite interior and exterior surfaces and a cylindrical side wall extending around the interior and exterior surfaces, a cylindrical wall on the base interior surface, and an orifice through the base interior and exterior surfaces positioned inside the cylindrical wall, the base interior surface being attachable to the container with the orifice aligned with the container opening;

a valve retainer having a peripheral surface engaging with the base cylindrical wall and attaching the valve retainer to the base interior surface, the valve retainer having at least one hole through the valve retainer;

a tubular valve element, the valve element having a center axis that defines mutually perpendicular axial and radial directions, the valve element being positioned radially inside of the valve retainer hole and the base interior surface, the valve element being movable radially relative to both the base and the valve retainer between a closed position and an opened position where in the closed position the valve element engages the base interior surface and blocks communication of the base orifice through the valve retainer hole with the opening of the container attached to the closure, and in the opened position the valve element is displaced from the base interior surface and opens communication of the base orifice through the valve retainer hole with the opening of the container attached to the closure, the valve element being biased toward the closed position.

8. The container closure of claim 7, further comprising:

a lid connected to the base for movement between closed and opened positions of the lid relative to the base where in the closed position the lid covers the base orifice and in the opened position the lid is displaced from the base orifice.

9. The container closure of claim 7, further comprising:

a cavity recessed into the base interior surface;

the base cylindrical wall extending around the cavity; and, the valve retainer and the valve element being positioned in the cavity.

10. A container closure that is attachable to a container to cover over an opening of the container, the container closure comprising:

a base having opposite interior and exterior surfaces and an orifice passing through the base interior and exterior surfaces, the base interior surface being attachable to the container with the base orifice aligned with the container opening; and, a valve element attached to the base adjacent the base interior surface, the valve element having a tubular shape with a center axis that defines mutually perpendicular axial and radial directions, the valve element having opposite exterior and interior surfaces that extend axially through the base to a circular edge between the exterior and interior surfaces of the valve element, the valve element exterior surface opposing the base interior surface and the valve element interior surface extending around the orifice, and the valve element being flexible allowing the valve element exterior surface to move relative to the base between a closed position and an opened position where in the closed position the valve element exterior surface engages with the base interior surface and closes communication of the base orifice with an opening of a container attached to the base, and in the opened position the valve element exterior surface is displaced from the base interior surface and opens communication of the base orifice with the opening of a container attached to the base, and the valve element tube shape biasing the valve element exterior surface toward the closed position.

11. The container closure of claim 10, further comprising:

the base having a cavity in the base interior surface with a cylindrical wall surrounding the cavity and the orifice; and, the valve element being positioned inside the cavity.

12. The container closure of claim 10, further comprising:

the base having a cylindrical wall that surrounds the orifice and extends around the valve element.

13. The container closure of claim 10, further comprising:

the valve element interior surface being sealed from the container opening and the valve element exterior surface communicating with the container opening when the base interior surface is attached to the container.

14. A container closure that is attachable to a container to cover over an opening of the container, the container closure comprising:

a base having opposite interior and exterior surfaces and a side wall extending around the interior and exterior surfaces, a cylindrical wall on the base interior surface, an orifice through the base interior and exterior surfaces positioned inside the cylindrical wall of the base, the base interior surface being attachable to the container with the base orifice aligned with the container opening;

a valve element attached to the base positioned inside the base cylindrical wall and adjacent the base orifice, the valve element having a tubular shape with an exterior surface opposing the base interior surface and an opposite interior surface, the valve element being flexible allowing the valve element exterior surface to move relative to the base between a closed position where the valve element exterior surface engages with the base interior surface and closes communication of the orifice with an opening of a container attached to the base, and an opened position where the valve element exterior surface is displaced from the base interior surface and opens communication of the orifice with the opening of the container attached to the base, the valve element tubular shape biasing the valve element exterior surface toward the closed position, the valve element interior surface being sealed from the container opening and the valve element exterior surface communicating with the container opening when the base interior surface is attached to the container.

15. The container closure of claim 14, further comprising:

the base having a cavity in the base interior surface with a cylindrical wall surrounding the cavity and the orifice; and, the valve element being positioned inside the cavity.

16. The container closure of claim 14, further comprising:

the base having a cylindrical wall that surrounds the orifice and extends around the valve element.

17. A container closure that is attachable to a container to cover over an opening of the container, the container closure comprising:

a base having opposite interior and exterior surfaces and an orifice passing through the base interior and exterior surfaces, the base interior surface being attachable to the container with the base orifice aligned with the container opening; and, a valve element attached to the base adjacent the base interior surface, the valve element having a tubular shape with a center axis that defines mutually perpendicular axial and radial directions, the valve element having opposite interior and exterior surfaces that extend axially through the base to a circular edge between the exterior and interior surfaces of the valve element, the valve element exterior surface opposing the base interior surface and the valve element interior surface surrounding the base orifice, and the valve element being flexible allowing the valve element exterior surface to move relative to the base between a closed position and an opened position where in the closed position the valve element exterior surface engages against the base interior surface and blocks communication of the base orifice with an opening of a container attached to the container closure, and in the opened position the valve element exterior surface is displaced from the base interior surface and opens communication between the base orifice and the opening of the container attached to the container closure, and the valve element being biased toward the closed position.

18. The container closure of claim 17, further comprising:

the base having a cavity in the base interior surface with a cylindrical wall surrounding the cavity and the orifice; and, the valve element being positioned inside the cavity.

19. The container closure of claim 17, further comprising:

the base having a cylindrical wall that surrounds the orifice and extends around the valve element.

20. The container closure of claim 17, further comprising:

the valve element interior surface being sealed from the container opening and the valve element exterior surface communicating with the container opening when the base interior surface is attached to the container.

21. A container closure that is attachable to a container to cover over an opening of the container, the container closure comprising:

a base having opposite interior and exterior surfaces and a side wall extending around the interior and exterior surfaces, a cylindrical wall on the base interior surface, and an orifice through the base interior and exterior surfaces positioned inside the cylindrical wall of the base, the base interior surface being attachable to a container with the base orifice aligned with the container opening;

a valve element attached to the base positioned inside the base cylindrical wall and adjacent the base orifice, the valve element having a tubular shape with opposite exterior and interior surfaces, the valve element exterior surface opposing the base interior surface and the valve element interior surface surrounding the base orifice, and the valve element being flexible allowing the valve element exterior surface to move relative to the base between a closed position and an opened position where in the closed position the valve element exterior surface engages against the cylindrical wall and closes communication between the base orifice and an opening of a container attached to the container closure, and in the opened position the valve element exterior surface is displaced from the cylindrical wall and opens communication between the base orifice and the opening of the container attached to the container closure, the valve element being biased toward the closed position, the valve element interior surface being sealed from the container opening and the valve element exterior surface communicating with the container opening when the base interior surface is attached to the container.

22. The container closure of claim 21, further comprising:

the base having a cavity in the base interior surface with the cylindrical wall surrounding the cavity and the orifice; and, the valve element being positioned inside the cavity.

23. The container closure of claim 21, further comprising:

a lid that is positionable over the base exterior surface to cover over the orifice and is removable from over the base exterior surface to expose the orifice.

* * * * *